United States Patent [19]

Whitaker

[11] Patent Number: 4,483,475

[45] Date of Patent: Nov. 20, 1984

[54] NAIL DRIVER

[76] Inventor: Nicholas Whitaker, 3284 A-G-A Rd., Hood River, Oreg. 97301

[21] Appl. No.: 446,248

[22] Filed: Dec. 2, 1982

[51] Int. Cl.[3] ..... B25C 1/02

[52] U.S. Cl. ..... 227/147; 227/149

[58] Field of Search ..... 227/113, 147, 149

[56] References Cited

U.S. PATENT DOCUMENTS

| | | | |
|---|---|---|---|
| 4,065,045 | 12/1977 | Pray | 227/147 |
| 4,085,882 | 4/1978 | Stamper | 227/147 X |
| 4,299,021 | 11/1981 | Williams | 227/147 X |

*Primary Examiner*—Paul A. Bell

*Attorney, Agent, or Firm*—Chernoff, Vilhauer, McClung, Birdwell & Stenzel

[57] ABSTRACT

A nail driving tool includes a plunger rod attached to one end of a cylindrical handle including a radially extending finger guard located at the end of the handle nearer the plunger rod. A guide tube fits slidably on the plunger rod and has a flange extending radially from one end. When the flanged end of the guide tube is adjacent to the handle the plunger rod can be pushed through the guide tube until the driving face of its tip is approximately even with the opposite end of the guide tube. When the plunger rod is inserted into the guide tube with the flanged end away from the handle, the tube end fits to a predetermined depth into a cavity in the handle, exposing the tip of the plunger rod to that extent beyond the flange, for countersinking nails to the predetermined depth.

2 Claims, 4 Drawing Figures

NAIL DRIVER

BACKGROUND OF THE INVENTION

The present invention relates to improvements in devices for driving nails in places where it is difficult to use an ordinary hammer.

There are many places where it is desirable to drive nails to hold structural members together, but where the proximity of objects which can be moved only with great difficulty makes it impossible to swing a hammer to drive the nails. For example, when assembling forms for pouring concrete it is often desirable to place nails in places where reinforcing bar material interferes with the ability to swing a hammer. Similarly, clearance is often limited above and below cabinets, making it difficult to drive nails which may be required to support the cabinets, or to attach moldings.

In other situations there is room enough to permit use of a hammer to drive nails, but proximity to finished surfaces may make it undesirable to use a conventional hammer.

In many situations the angle from which access is available to the location where a nail must be placed makes use of an ordinary hammer very awkward or difficult.

In yet other situations it is desirable to set nails below the level of the surrounding surface. For example, when installing gypsum wallboard, nails are commonly countersunk, and joints and nail holes are filled during finishing of a wall. Driving nails below the surface plane of a sheet of wallboard requires use of a nail set, ordinarily, in addition to a hammer.

In the past one way of installing nails in such difficult places has been to use as a guide a slender tube whose interior size permits a nail to slide through the tube, and to use a hammer to drive a rod which fits slidably within the tube and is held against the head of the nail. Use of such a tube and rod combination makes it possible to drive nails in otherwise inaccessible or awkward locations. It is difficult, however, to use the tube, rod, and hammer combination safely in overhead locations. There, the rod is likely to slide out of position unless it is held by the user, and holding the rod creates a risk of pinching the user's fingers between the rod and the guiding tube.

Another previously known device for driving nails in awkward or inaccessible locations is a combination of a tube and a rod slidable through the tube to drive against the head of a nail, the rod having a spherical handle at one end. While such a device is an improvement over driving the rod with an ordinary hammer, the combined weight of the rod and spherical handle of the available tools of this type is too small for effectively driving nails. Also, the tool is still subject to the disadvantage of the previously known combination, in that it is easily possible to pinch the user's fingers between the rod and the tube, or between the ball and the tube. Additionally, there is no gauge provided for countersinking a nail to any predetermined depth.

What is desired, then, is an improved device which can be used to drive nails in locations where it is difficult or impossible to drive nails using a hammer. Such a tool should include provisions to prevent the user from pinching himself during use of the tool and should preferably provide a capability to countersink nails to a predetermined depth.

SUMMARY OF THE INVENTION

The present invention supplies the need for a tool which can be used to drive nails in places which are difficult to reach or where there is insufficient room for use of an ordinary hammer. The nail driver of the present invention comprises a guide tube whose interior diameter is slightly larger than the head of a nail which is to be driven.

A plunger rod fits snugly but is easily slidable within the guide tube. Attached to one end of the plunger rod is a massive generally cylindrical handle which extends coaxially with the rod. A finger guard is located at the end of the handle to which the plunger rod is attached, and a flange is located at one end of the guide tube.

The length of the plunger rod extending beyond the handle is approximately equal to the length of the guide tube, so that when the flanged end of the guide tube is held against the handle the nail driving end of the plunger rod is approximately flush with the other end of the guide tube. A shallow cavity in the end of the handle surrounds the plunger rod but is too small to receive the flange.

However, if the guide tube is reversed end for end on the plunger rod the unflanged end of the guide tube fits into the cavity a predetermined maximum distance, permitting the nail driving end of the plunger rod to extend beyond the flange at the opposite end of the guide tube a distance to which it is desired to countersink a nail. The nail driver of the present invention is particularly useful in this mode, since the flanged end of the guide tube may be used to press against a sheet of material such a gypsum wallboard to hold it in place. A nail can then be driven to attach the material in a desired location without the need for an assistant to hold the material or a nail set to countersink the nail.

It is therefore a primary objective of the present invention to provide an improved easily usable hand tool for driving nails in locations which are out of reach of conventional hammers or where it is awkward to hold a nail by hand to start driving it.

It is another important objective of the present invention to provide a tool which may be used to drive nails without risk of pinching the fingers of the user.

It is a further objective of the present invention to provide a tool usable for sinking nails to a predetermined depth.

It is an important feature of the present invention that it includes a flange on one end of a guide tube and a plunger rod which extends through the tube and a predetermined distance beyond the flange to countersink a nail driven through the guide tube to a predetermined depth.

It is another important feature of the nail driver of the present invention that it includes a heavy handle which provides enough momentum to easily drive nails in any direction.

It is an important advantage of the present invention that it is safer than previously known tools for the same purpose.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
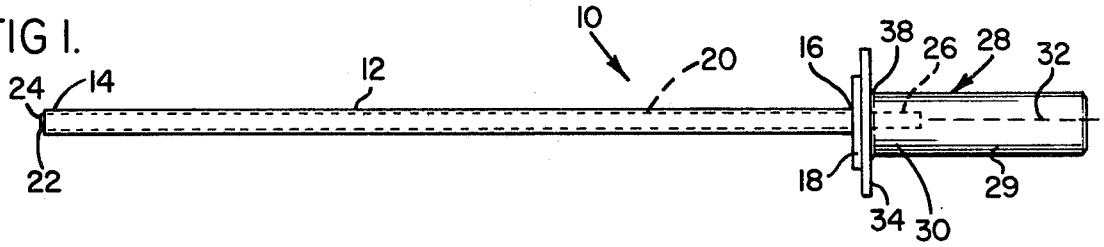
FIG. 1 is a side view of an exemplary nail driver according to the present invention.
Figure 2:
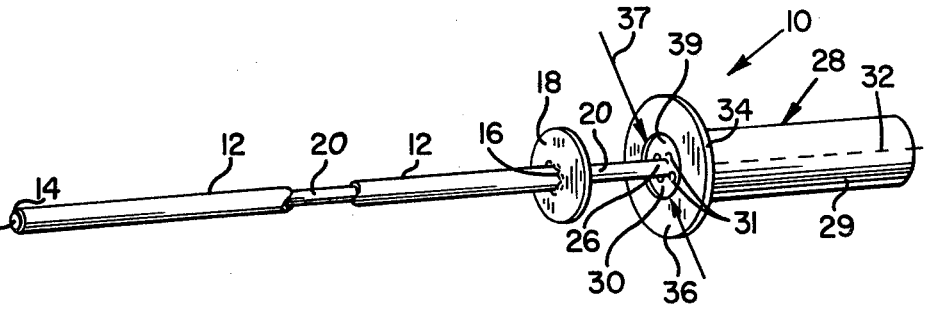
FIG. 2 is a perspective view of the nail driver shown in FIG. 1, with the guide tube shown partially cut away and shortened for clarity.

Referring now to the drawings, and particularly to FIGS. 1 and 2, a nail driver 10 is a preferred embodiment of the present invention. It comprises a guide tube 12 of a convenient length, for example approximately 18 inches (46 centimeters). The guide tube 12 may be of steel or other suitably strong material, and has an internal diameter large enough to permit a nail to slide through the tube but small enough to keep the nail oriented within a few degrees of the direction of the guide tube 12 itself. For example, for use with 6d–12d common nails, a steel tube with an inside diameter of ⅜ inch (9.5 mm) and an outside diameter of ½ inch (1.27 cm) is suitable.

A first end 14 of the guide tube 12 is cut off square. Its edges may be rounded somewhat to avoid unnecessary damage to material being nailed. Attached to a second end 16 is a radially extending flange 18, for example, a steel washer having an inside diameter which matingly fits over the outside of the guide tube 12. The flange 18 is fixedly attached to the second end 16, as by welding it to the guide tube 12, with the flange 18 flush with the second end 16.

A plunger rod 20 fits within the guide tube 12, where it is freely slidable, but fills the guide tube 12 closely enough to prevent a nail from being caught between the plunger rod 20 and the interior surface of the guide tube 12. An outer end 22 of the plunger rod includes a nail driving face 24 which is substantially perpendicular to the length of the plunger rod 20. The opposite or inner end 26 of the plunger rod 20 is attached fixedly to a handle 28.

The handle 28 includes a body 29 which is preferably cylindrical in shape and made of steel. It may, for example, be made from steel bar stock approximately 5 inches (12.7 cm) long and 1¼ inches (3.2 cm) in diameter, and weigh 2 pounds (0.9 Kg). The handle 28 has a longitudinal central axis 32, and the plunger rod 20 preferably extends coaxially from the body 29. The plunger rod 20 may be fastened into a snugly fitting hole in the body 29 by punching an inner end 30 of the handle 28 at locations 31 spaced around the plunger rod 20, as shown in FIG. 2.

A finger guard 34 portion of the handle 28 extends radially outward from inner end 30 of the handle 28 a distance sufficient to prevent the user's fingers from accidentally sliding off the handle 28 toward the plunger rod 20 during use of the nail driver 10. A finger guard 34 extending radially about 9/16 inch (1.43 cm) outward beyond the cylindrical outer surface of the body 29 has been found satisfactory. The finger guard 34 preferably is in the form of an annular flat disc such as a washer 36 whose thickness is approximately ⅛ inch (3 mm) and whose inner diameter is larger than the outside diameter of the guide tube 12 but smaller than the outside diameter of the flange 18. Such an annular disc 36 may be attached to the body 29 by a circumferential weld 38. This assures that substantial force may be applied against the finger guard 34 while driving a nail without separating the annular disc 36 from the body 29.

The annular disc or washer 36 is attached to the body 29 concentric with the plunger rod 20, the central opening in the annular disc 36 defining a cavity 39 at the inner end 30 of the handle 28. The diameter of the cavity 39 is thus defined by the interior diameter 37 of the annular disc 36 and the depth of the cavity 39 is defined by the thickness of the annular disc 36, which is chosen to be equal to a maximum depth to which it is desired to countersink the head of a nail 40.

The length of the plunger rod 20 is chosen to correspond to the length of the guide tube 12. Thus, with the plunger rod 20 inserted into the guide tube 12 and the flange 18 in contact with the inner end 30 of the handle 28, or more specifically, in contact with the annular disc 36, the nail driving face 24 of the plunger rod 20 is exposed substantially even with the outer end 14, that is, the nail driving face 24 will be located not more than 1/16 inch (1.6 mm) beyond the outer end 14 of the guide tube 12. Such a slight protrusion, if present, will permit a nail to be driven fully, even when not perpendicular to the surface into which it extends.

Figure 3:
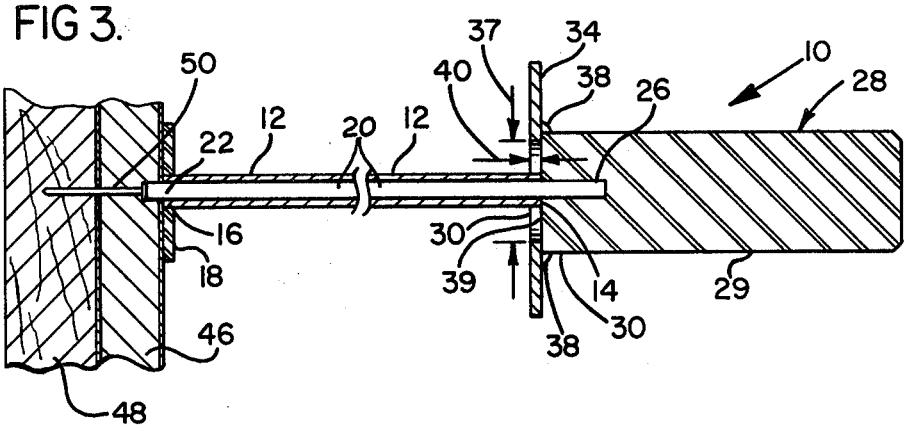
FIG. 3 is a shortened sectional side view of the nail driver shown in FIG. 1, on an enlarged scale, showing the method of its use for holding wallboard and countersinking a nail.

As may be seen in FIG. 3, the guide tube 12 may also be placed over the plunger rod 20 in the opposite orientation, with the outer end 14 of the guide tube 12 closer than the flanged inner end 16 to the handle 28. This assembly arrangement permits the outer end 14 to extend into the cavity 39, allowing nail driving face 24 to extend from the guide tube 12 a distance equal to the depth 40 of the cavity 39 (the thickness of the annular disc 36) in addition to any slight distance of protrusion as mentioned above.

Figure 4:
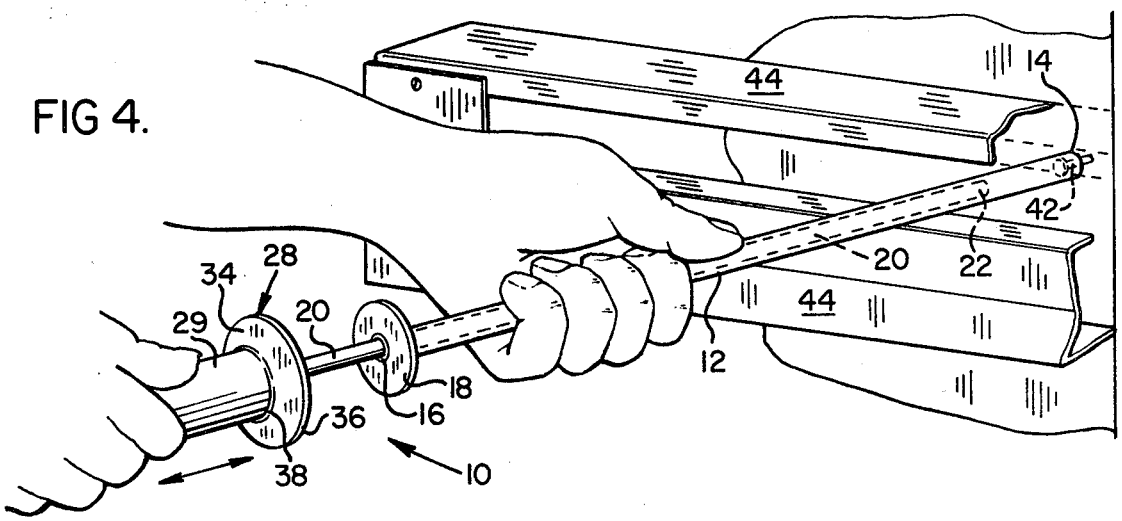
FIG. 4 is a perspective view of the nail driver shown in FIG. 1, showing the manner of its use.

The nail driver 10 of the present invention permits a user to drive nails in places which are inaccessible to an ordinary carpenter's hammer. For example, a nail 42 can be driven within a baseboard heating element 44 as shown in FIG. 4, by withdrawing the plunger rod 20 at least part way from within the guide tube 12 and placing the nail 42 within the guide tube 12. Ordinarily this should be done with the flange 18 and the inner end 16 of the guide tube 12 facing toward the handle 28. The outer end 14 of the guide tube 12 is held in contact with the location where the nail 42 is to be driven and the handle 28 and plunger rod 20 are moved forward into the guide tube 12 so that the driving face 24 of the plunger rod strikes the head of the nail 42, driving it into the material against whose surface the outer end 14 is held. The nail 42 holds the outer end 14 in position laterally once it has been started into the surface against which the outer end 14 is held. The guide tube 12, in turn, supports the nail 42 in the desired orientation, preventing it from being bent as it is driven. The user holds the guide tube 12 with one hand and the handle 28 with the other. The finger guard 36 and flange 18 prevent the fingers from being pinched between the guide tube 12 and the handle 28 while the nail 42 is being driven.

To drive nails horizontally, in an upwardly inclined direction, or into overhead locations the plunger rod need be withdrawn only partially from the guide tube 12. The user may grasp the plunger rod 20 and hold the flange 18 with the fingers and thumb of one hand, leaving the other hand free to drop a nail into the outer end 14 with its head downward within the guide tube 12. The guide tube 12 then contains the nail until it has been started.

In a situation where a nail must be driven downward into a location which is inaccessible for use of an ordinary hammer, the plunger rod 20 is withdrawn fully from the guide tube 12. The outer end 14 is placed against the surface of the material into which the nail is to be driven and held in that position as the nail is dropped through the guide tube 12 with its point downward. The plunger rod 20 is then reinserted into the guide tube 12 and the nail is driven by reciprocatingly moving the handle 28, allowing the driving face 24 to strike the head of the nail.

The nail driver of the invention is particularly useful in attaching sheathing material such as a sheet 46 of gypsum wallboard to a frame member 48 as shown in FIG. 3. For this purpose the guide tube 12 is placed upon the plunger rod 12 with the outer end 14 nearer the handle 28 and the flange 18 nearer the nail driving face 24. The flange 18 may then be used to push against the sheet 46 of wallboard to hold the sheet 46 of wallboard against the frame member 48 as shown in FIG. 3, as a nail 50 is driven to attach the sheet 46 to the frame member 48.

Since the outer end 14 can enter into the cavity 39, the nail driving face 24 is free to extend beyond the flange 18 to countersink the nail to a depth which provides a strong surface for retaining seam filler or spackling material to provide a smooth finished surface on the wallboard. The depth of countersinking the nail 50 is gauged by the depth 40 of the cavity 39, since the nail driving face 24 is able to protrude beyond the flange 18 and inner end 16 by the distance to which the outer end 14 extends into the cavity 39. Thus, when driving the nail 50 with the flange 18 against the surface of the sheet 46, the nail 50 will be countersunk properly when the handle 28 strikes the outer end 14 of the guide tube 12.

While the nail driver 10 has been described in a particular size useful with nails of sizes within a certain range, it will be appreciated that variations in the diameters and lengths of the guide 12 and plunger rod 20 will be desirable for use of the nail driver 10 for widely different types and sizes of brads, nails, and spikes.

The terms and expressions which have been employed in the foregoing specifications are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tool for driving nails and similar fasteners, comprising:

(a) an elongate handle having first and second ends;

(b) a plunger rod, having an inner end and an outer end, said inner end being fixedly attached to said handle and said handle and said outer end ncluding a driving face;

(c) an elongate guide tube including an interior bore in which said plunger rod is slidably disposed, said guide tube having an inner end, an outer end, and a radially extending flange located on said outer end;

(d) finger guard means located proximate said first end of said handle and extending radially outward about said handle for preventing a user's fingers from slipping inadvertently from said handle toward said plunger rod during use of said tool; and (e) plunger limit stop means associated with said handle for limiting extension of said plunger rod through said guide tube, selectively either to a first position wherein said driving face is exposed within a first predetermined distance beyond an end of said guide tube or to a second position wherein said driving face is exposed a predetermined countersinking distance beyond an end of said guide tube, said plunger limit stop means including means defining a cavity located at said first end of said handle and surrounding a portion of said inner end of said plunger rod, for receiving said outer end of said guide tube therein to a maximum distance limiting extension of said driving face beyond said outer end of said guide tube to said predetermined countersinking distance, when said plunger rod has been inserted into said guide tube from said outer end thereof, and additionally including means associated with said first end of said handle for preventing said flange from entering said cavity when said plunger rod is inserted into said guide from said inner end thereof.

2. The tool of claim 1, wherein said handle is cylindrical and extends coaxially from said plunger rod, said means associated with said first end comprising an annular disc defining a central opening larger than said outer end of said guide tube but smaller than said flange, the thickness of said disc being substantially equal to said countersinking distance, said disc being fixedly attached to said first end of said handle with said central opening concentrically surrounding said plunger rod, said central opening thereby defining said cavity.

* * * * *

UNITED STATES PATENT AND TRADEMARK OFFICE

CERTIFICATE OF CORRECTION

PATENT NO. : 4,483,475

DATED : November 20, 1984

INVENTOR(S) : Nicholas Whitaker

It is certified that error appears in the above-identified patent and that said Letters Patent is hereby corrected as shown below:

Col 2, line 35 after "such" insert --as--.

Col 5, line 44 after "guide" insert --tube--.

Signed and Sealed this

*First* Day of *October 1985*

[SEAL]

*Attest:*

DONALD J. QUIGG

*Attesting Officer*

*Commissioner of Patents and Trademarks—Designate*